United States Patent [19]

Leach

[11] Patent Number: 4,772,775

[45] Date of Patent: Sep. 20, 1988

[54] ELECTRIC ARC PLASMA STEAM GENERATION

[76] Inventor: Sam L. Leach, P.O. Box 1190, Pebble Beach, Calif. 93953

[21] Appl. No.: 29,277

[22] Filed: Mar. 23, 1987

[51] Int. Cl.[4] ..... B23K 9/00

[52] U.S. Cl. ..... 219/121.36; 219/121.59; 219/121.48; 315/111.21; 322/2 R; 122/476

[58] Field of Search ..... 219/121 P, 121 PY, 121 PN, 219/121 PM; 313/231.31, 231.41, 231.51; 315/111.21; 322/2 R, 100; 202/106, 94, 82; 122/476, 460

[56] References Cited

U.S. PATENT DOCUMENTS

| | | | |
|---|---|---|---|
| 3,895,243 | 7/1975 | Amend et al. | 310/11 |
| 4,010,396 | 3/1977 | Ress et al. | 310/11 |
| 4,163,910 | 8/1979 | Matthews et al. | 310/11 |
| 4,200,815 | 4/1980 | Petrick et al. | 310/11 |
| 4,516,043 | 5/1985 | Vigil et al. | 310/11 |
| 4,523,113 | 6/1985 | Kallman | 322/2 |

*Primary Examiner*—M. H. Paschall

*Attorney, Agent, or Firm*—Poms, Smith, Lande & Rose

[57] ABSTRACT

An electric arc plasma steam generator includes a pair of electrodes for generating the arc plasma, and a housing for enclosing the arc plasma. Jets of water are directed into the arc plasma to convert the water into steam and to ionize the hydrogen and oxygen components of the steam. Arrangements including coils and water jackets are provided for circulating water in proximity to the arc plasma and for super-heating the water contained in the water jacket and/or the coils, which are preferably mounted within the housing. An expansion chamber is connected to receive both the super-heated water, and also the superheated steam from the arc plasma, as the hydrogen and oxygen recombine to form steam once again. The arc plasma in one embodiment may be formed by electrical conduction through a spray of water containing an electrolyte; and in another embodiment electrodes may initially form the arc plasma in air or other gas, and as the electrodes are consumed, they may be advanced by a suitable mechanical arrangements including threads on the electrodes, keyway slots on the electrodes, and stepping motors which serves to advance the electrodes as needed.

19 Claims, 5 Drawing Sheets

ELECTRIC ARC PLASMA STEAM GENERATION

FIELD OF THE INVENTION

This invention relates to steam generation.

BACKGROUND OF THE INVENTION

Steam generation is normally accomplished using boilers, and heat transfer tubes with the heat supplied either within or outside of the tubes, and water to be heated on the other side of the walls of the tubes.

Steam generation boilers are relatively inefficient, and a principal object of the present invention is to provide a simpler, more efficient system and method for generating steam.

SUMMARY OF THE INVENTION

In accordance with a broad aspect of the present invention, steam is generated by the injection of water, preferably jets of water, into an electric arc plasma.

The gas plasma may be formed by ionizing a water spray containing an electrolyte to increase the conductivity of the water. A substantial electrical potential is employed to initiate ionization and to maintain the resultant gas plasma in its ionized state. Water jets may be directed into the plasma arc, thereby reducing the arc temperature, vaporizing the water, and ionizing the hydrogen and oxygen atoms. The partially cooled plasma is directed adjacent heat exchange arrangements, such as coils, through which water is directed, and this water is rapidly super-heated. The super-heated water is then directed to an expansion chamber where the super-heated water expands and becomes steam.

In accordance with another embodiment of the invention the arc plasma may be established between two metallic electrodes, and the water jets may be directed into the arc plasma. The electrodes may be very slowly consumable and may be mechanically advanced to maintain the desired arc spacing.

As mentioned above, the arc plasma, following some reduction in temperature from the impinging water jets, may come into heat transferring proximity to one or more coils of metal tubing carrying water; and the channel carrying the plasma arc and ionized gases may be enclosed by a water jacket. The flow of water through the jets and through the coils of metal tubing and the water jacket or jackets, are at a rate so that the plasma has cooled to become steam at the remote end of the channel.

With regard to the embodiment of the invention using water containing electrolyte to form the gas plasma arc, the system may include a tank containing a saturated solution of electrolyte in water, and arrangements for diluting the electrolyte solution before spraying it into the active unit, and a sump for collecting electrolyte which has not been converted into steam, and for recirculating the electrolyte into the spray to the arc plasma generator.

As another facet of the invention, additional energy may be supplied to the steam generation process by the oxidation of electrode material, or of material which may be added in suspension to the injected water.

It is further noted that the electrodes may be advanced by a mechanism including an elongated electrode which is threaded and provided with an external slot or keyway. The electrode may be either threaded internally and may be rotated by a stepping motor coupled to a gear engaging the keyway; or alternatively, the electrode may be externally threaded, and held against rotation by the keyway while it is advanced by a gear member threaded internally to mate with the external electrode threads, with the gear member having external spur gear teeth which are driven by a stepping motor provided with a drive gear.

Other objects, features and advantages of the invention will become apparent for a consideration of the following detailed description, and from the accompanying drawings.

DETAILED DESCRIPTION

Figure 1:
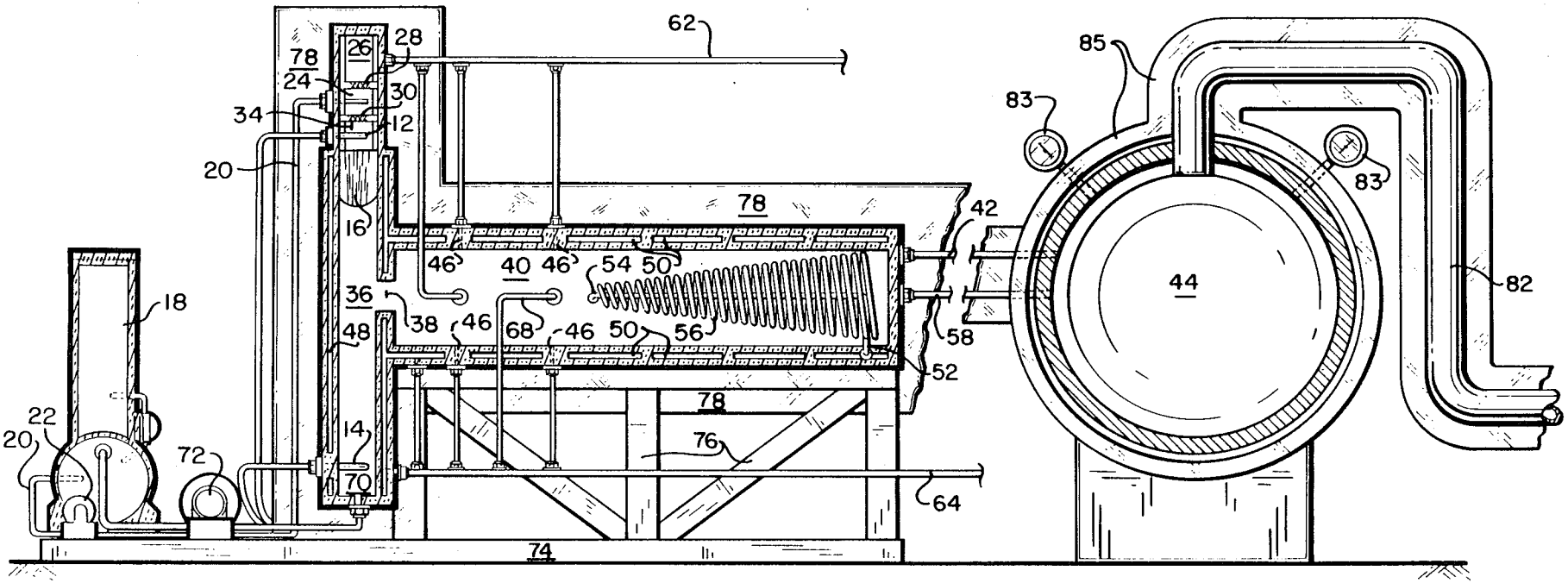
FIG. 1 is a diagrammatic showing of an electric arc plasma steam generation system illustrating the principles of the present invention.

Referring more particularly to the drawings, the system of FIG. 1 is an electric arc plasma generation system wherein the high voltage electrodes 12 and 14 may be mounted approximately 48 inches apart, and may provide an energizing voltage in the order of approximately 2500 volts. A spray of a very dilute solution of water and an electrolyte such as sodium sulphate is supplied from the ceramic member 16 which has a large number of very small diameter holes extending through it from top to bottom. A saturated solution of the sodium sulphate may be maintained in the tank 18, and is supplied through the pipe 20 by the input electrolyte pump 22. The concentrated electrolyte is brought into the section 24 of the input compartment above the spray member 16. Water to dilute the concentrated electrolyte is brought into the chamber 26 in this upper compartment, and is mixed with the concentrated electrolyte by use of the mixing plates 28 and 30 which are provided with a series of angled holes to provide thorough mixing of the water with the concentrated electrolyte. Accordingly, by the time the electrolyte reaches the chamber 34 immediately above the spray member 16, it is at a relatively dilute concentration desired for spraying into the chamber 36 where the arc plasma will be formed.

Once the arc plasma is formed, the sprayed water will be converted to steam, and the steam will in turn have its components ionized so that the electric arc plasma will include the normal air present in the chamber, and hydrogen and oxygen ions from the water and steam. The very high temperature ionized gases will then flow through the opening 38 into the chamber 40, as a result of the presence of the output pipe 42, coupling chamber 40 with the steam expansion chamber 44 which appears to the right in this FIG. 1 of the drawings. The arc plasma which is formed raises the temperature of the gas to a very high level, in the order of 50,000 to 100,000 degrees Fahrenheit, and these very high temperature ionized gases will be directed vigorously through the opening 38 down the center of the chamber 40.

Water jets are then directed through the nozzles 46 into the center of the plasma. This will have the effect of instantaneously converting the input jets of water into steam, and in many cases into ionized gas particles, and also will have the collateral effect of cooling down the plasma as it passes from left to right through the chamber 40. It may be also noted that the chambers 36 and 40 are provided with water jackets, 48 and 50, respectively through which water flows and is heated. Following flow through the water jackets 48 and 50, water is directed by the metal pipe or tubing 52 to the front turn 54 of the coil 56, serving the function of further heating the water supplied to coil 56, and of further cooling the ions and steam present in the chamber 40 and flowing from left to right therein. By the time the water flowing in coil 56 reaches the output of pipe 58 coupling it to the steam expansion chamber 44, it is at a very high temperature, in the order of a few thousand degree Fahrenheit. Accordingly, when the super-heated water from pipe 58 is permitted to enter the expansion chamber 44, it immediately turns to steam.

Concerning other points relative to the system of FIG. 1, it may be noted that the cold water or ambient temperature water is supplied to the system at input of pipes 62 and 64. It may also be noted that the pipes 66 and 68 supply water to jets which spray in toward the center of the chamber 40 from the near side thereof, and similar jets are provided on the rear of the chamber 40, so that water is sprayed into the chamber at least from 8 points, as shown in FIG. 1, and a larger number of input radially directed jets may be employed if desired.

Concerning another point, a sump 70 is provided below the electrode 14, with the pump 72 returning the reclaimed electrolyte to the tank 18 including the saturated solution of electrolyte.

A conventional mechanical base 74 and supporting the framework 76 is provided for the unit; and a thick layer of high temperature insulation 78 encloses the entire apparatus, to reduce thermal losses, due to the very high temperatures which are present within the unit. Steam from the expansion chamber 44 is supplied through the large diameter steam delivery channel 82 to power turbines or the like. Steam pressure gauges 83 measure the pressure in chamber 44. Insulation material 85 is provided around the expansion chamber 44 and conduit 82, to reduce heat losses.

In the foregoing description of FIG. 1, the system was described wherein the arc is initiated between two electrodes with a spray of water containing a dilute solution of an electrolyte being directed between the two electrodes. In the embodimentof FIG. 2 a different configuration of electrodes is employed, in which a plasma arc is initiated in air or gas between metallic electrodes, and arrangements are provided for advancing the electrodes, as they are consumed or erode.

Figure 2:
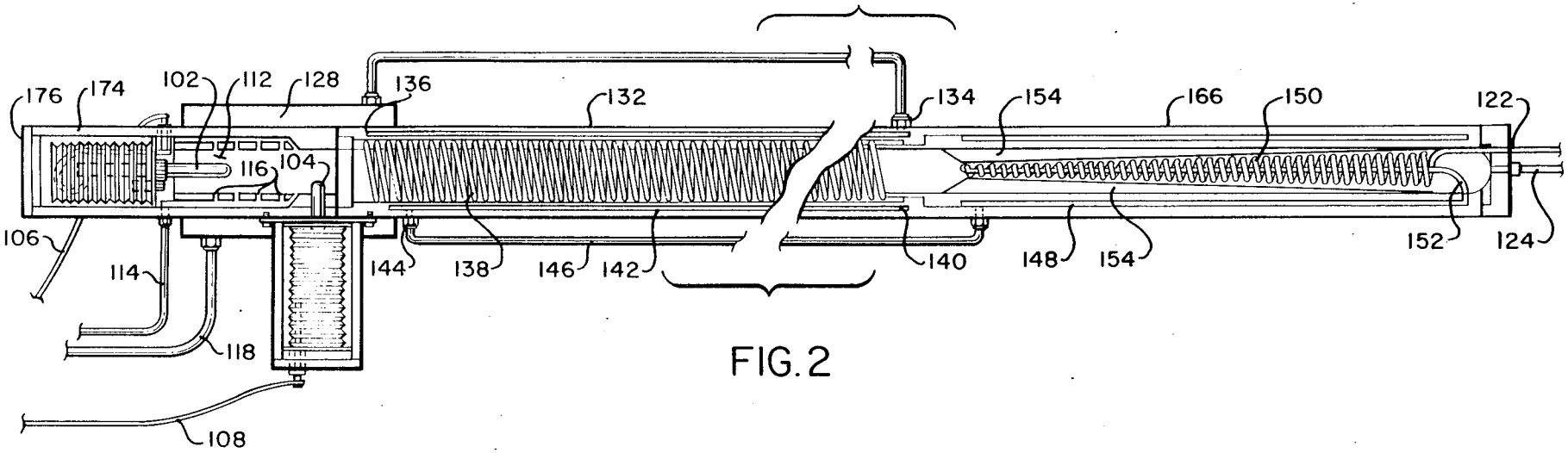
FIG. 2 is a cross-sectional showing of an alternative embodiment of the invention illustrating the principles thereof.

Referring now in detail to FIG. 2, it includes the two electrodes 102 and 104 between which an electric arc plasma is established, by the application of high voltage on the input conductors 106 and 108. The arc between the electrodes 102 and 104 may initially be started as a result of the breakdown of air of other gas present within the chamber 112, with the air or gas being supplied through a conduit 114. Once the electric arc plasma is initiated between electrodes 102 and 104, jets of water are sprayed into the volume 112, from a series of jet spray orifices 116 which are supplied from the input cold or ambient water pipe 118. The input jets of water from the orifices 116 provide the water which is immediately converted to steam and then to ionized gas, principally oxygen, hydrogen and electrons, within the chamber 112. From an overall standpoint, the system is comparable to the system of FIG. 1, in that various heat exchangers are provided to transfer the heat from the electric arc plasma to water from enclosing water jackets and from coils upon which the ionized gases impinge. Finally, the super-heated water is coupled to an expansion chamber (not shown) through the output pipe or tubing 122, while the steam from the main chamber is routed to the expansion chamber through the outupt conduit 124. The foregoing arrangements provide a vigorous left to right flow of the ionized hot gases from the electric arc plasma generation zone 112.

Now, considering the water flow in greater detail, it starts from the input pipe or conduit 118 and flows to the water jacket 128 which surrounds the main plasma arc chamber 112, and directs water to each of the jet orifices 116 which open from the water jacket 128. From the water jacket 128, the cooling water flows through the conduit 130 to a water jacket 132 which is coupled to the pipe 130 at the fitting 134. From the water jacket 132, the water is coupled at point 136 to one end of the coil 138. From the end of the coil 138 at point 140, the water flows into an inner water jacket 142, and is coupled by the fitting 144 to conduit 146 which directs the water to water jacket 148 toward the output end of the system of FIG. 2. The tapered or conical coil 150 receives water from the water jacket 148 by the short curved section of tubing 152 leading through the axis of the coil to the front end of the tapered coil 150. The output from the right-hand end of coil 150 is coupled to the output tube 122 leading to the expansion chamber of the type shown in FIG. 1. Radially extending, tapered support vanes 154 support the conical tapered coil 150 in its desired axial position, while permitting free passage of the gases from the arc discharge, now at least principally converted back to superheated steam. These vanes 154 may be made of a machinable ceramic material as noted below.

Figure 3:
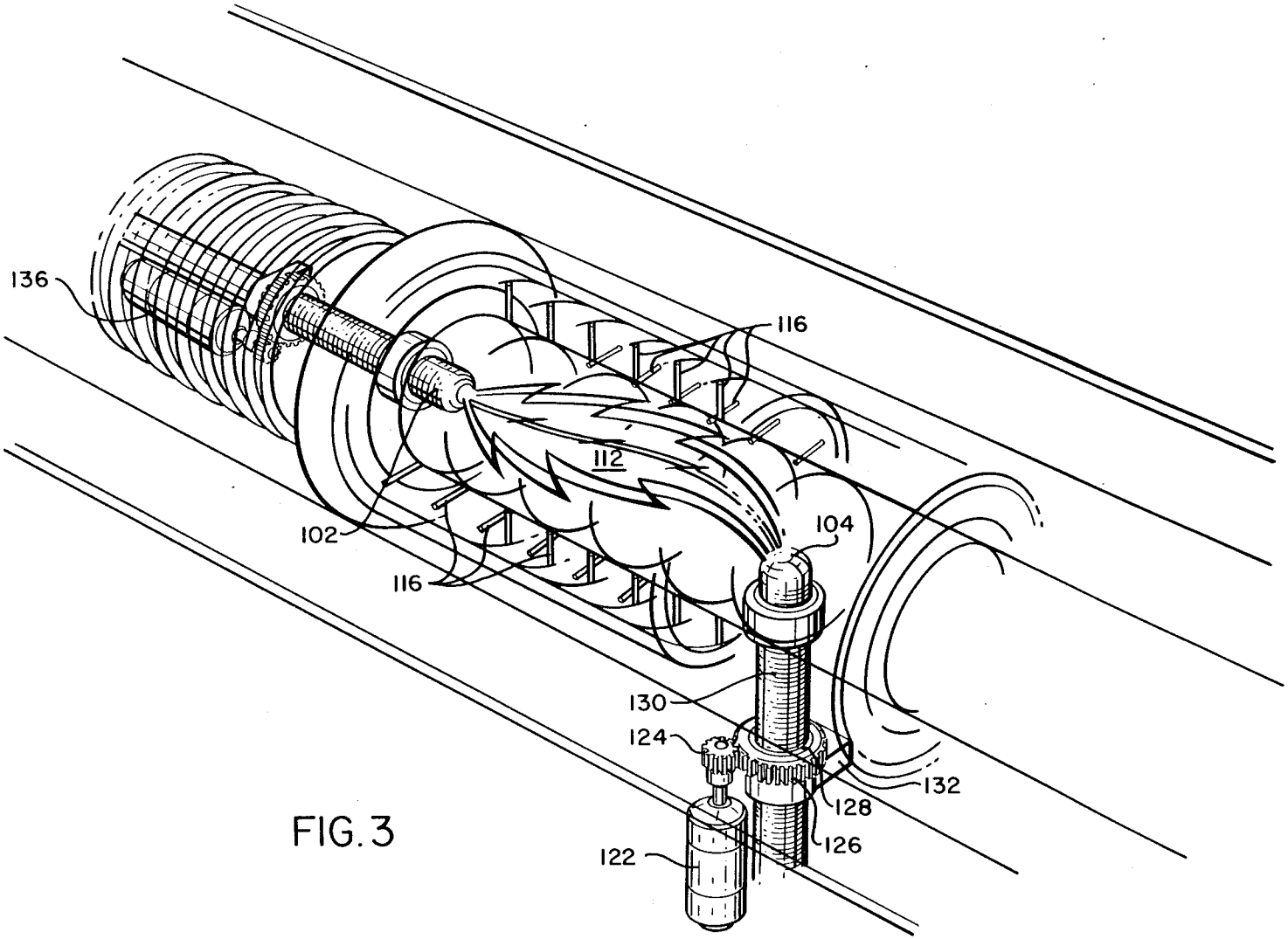
FIG. 3 is a diagrammatic showing of the arc plasma and the water injection portion of the system of FIG. 2.

FIG. 3 is an enlarged diagrammatic showing of the critical electric arc plasma generation zone 112 of the system of FIG. 2. The nozzles 116 by which jets of water are sprayed into the electric arc plasma zone from four directions, are also clearly shown in FIG. 3 of the drawings. In the embodiment as shown in FIG. 3 of the drawings, the exterior surfaces of the electrodes 102 and 104 are threaded, and are also provided with a slot for preventing their rotation. In operation, referring to electrode 104, a stepping motor 122 rotates the spur gear 124 which is turn rotates the mating spur gear 126 which has internal threads in the inner collar 128 which mesh with the exterior threads 130 on the electrode 104. The stationary block 132 has an inwardly extending rib which extends into a longitudinally extending recess (not shown) on the electrode 104, to prevent the rotation of electrode 104, and to constrain the movement of electrode 104 to the linear, axial direction, as the motor 122 is actuated and the gear assembly 126 is rotated. In a similar manner, actuation of the motor 136 associated with the electrode 102 causes the axial forward movement of electrode 102 to compensate for erosion which occurs at the outer end thereof.

Incidentally, when the electrode is formed of iron or an alloy containing substantial quantities of iron, the particles of iron which are oxidized provide additional energy to the system, conforming to the exothermic reaction whereby iron becomes iron oxide.

Figure 4:
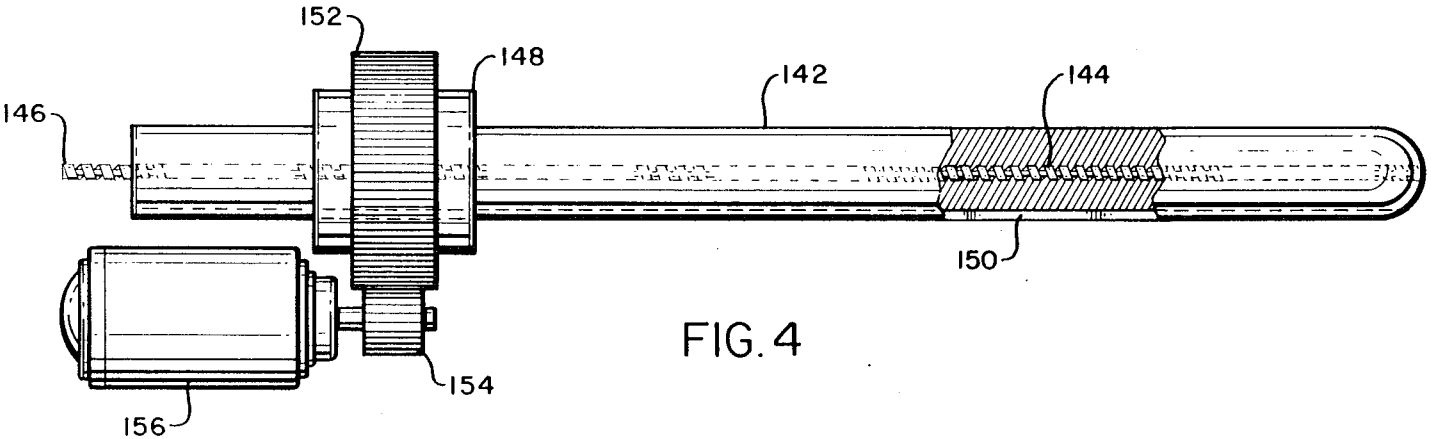
FIG. 4 is a diagrammatic showing of one arrangement for advancing the electrodes in the system of FIG. 2.

FIG. 4 shows an alternative arrangement for advancing the electrodes in which the electrode 142 has internal threads 144 which mate with the external threads on a fixed threaded member 146 which does not rotate. The collar 148 is provided with a rib which extends into a slotted keyway 150 in the side of the electrode 142, so that the electrode 142 rotate with the spur gear 152 which is secured to the ribbed collar 148. With the spur gear 154 in meshing engagement with the gear 152, when the stepping motor 156 is actuated the electrode 142 will rotate and will be advanced to the right, as a result of its internal engagement with the fixed, non-rotating threaded shaft 146. Of course, the motor 156 and its associated gears 154 and 152, together with the ribbed collar 148 secured to the gear 152, do not move axially with respect to the entire apparatus, but only the electrode moves to the right, as indicated in FIG. 4. In operation, the internally threaded electrode 142 of FIG. 4 operates in substantially the same manner as the externally threaded electrode 104 of FIG. 3, in that, as the motors are energized, the electrodes are advanced.

Figure 5:
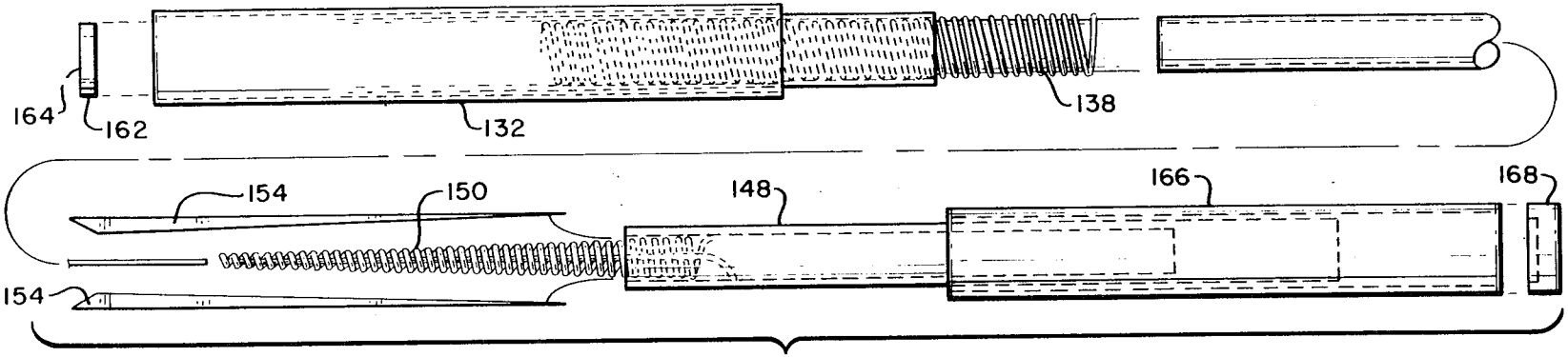
FIG. 5 is an exploded view of a number of the components of FIG. 2.

FIG. 5 shows the water jackets and the water coils, in greater detail, and in a partially exploded view, as compared with the showing of FIG. 2. In general, the parts as shown in FIG. 5 carry the same reference numerals as in FIG. 2. However, certain parts which were unnumbered in FIG. 2 include the input collar 162 which directs ionized gas through the central opening 164 into a heat conducting relationship with the coil 138 and the water jacket 132. Similarly, the outer housing 166, toward the right-hand end of the unit, was not previously mentioned in connection with FIG. 2, nor was the end closure member 168.

Figure 6:
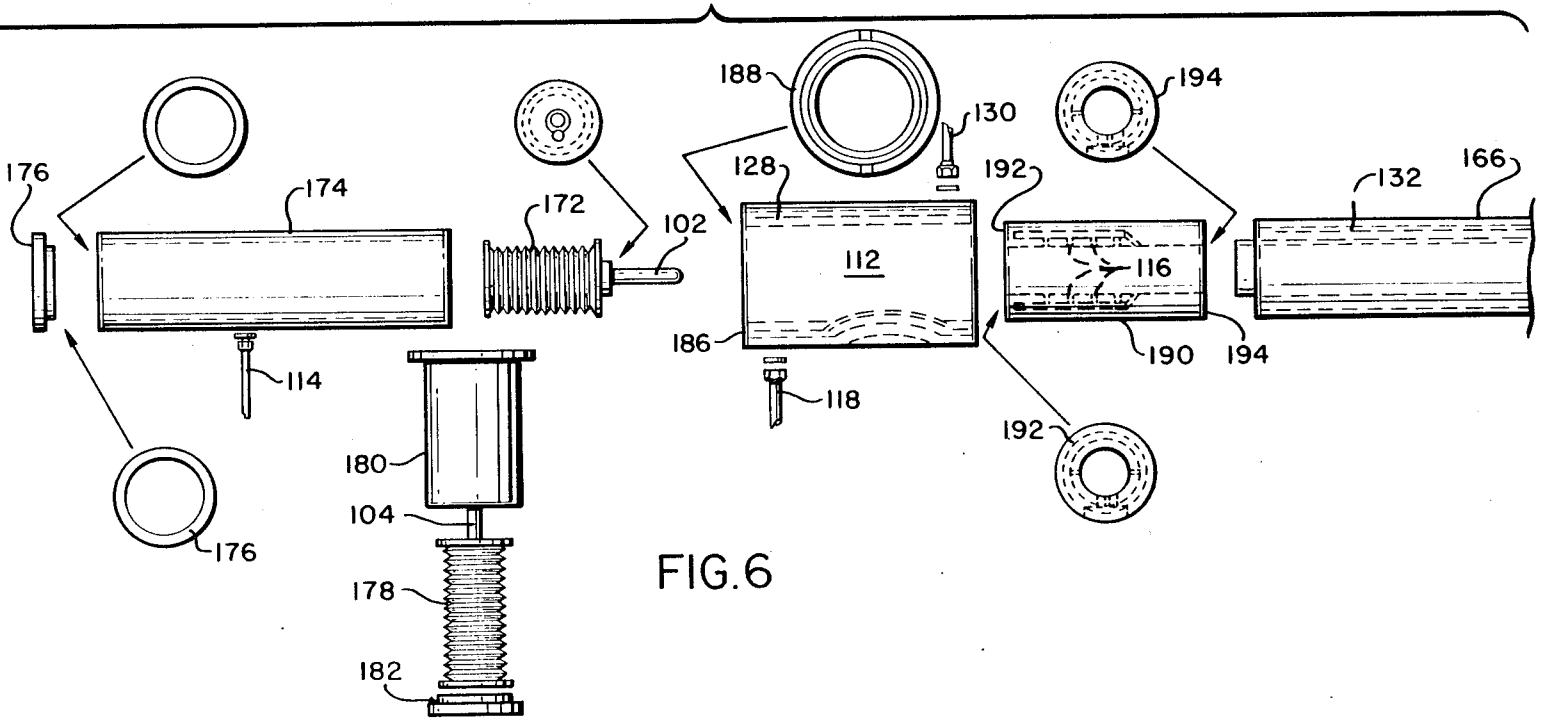
FIG. 6 is an exploded view showing additional components of the system of FIG. 2.

FIG. 6 is another exploded view, showing some of the remaining parts of FIG. 2, which were not previously described separately. In FIG. 6, the parts bear the same reference numerals as those used in FIG. 2. Pertinent parts which appear in FIG. 6 which were not specifically mentioned in connection with the decription of FIG. 2 will now be identified. The input electrode 102 is enclosed within the stainless steel bellows 172 to more positively seal the unit against the escape of the high pressure and high energy gases from the arc plasma. Further, the electrode bellows assembly 102, 172 is mounted within the metal cylinder 174 which is closed by a sealing end plate 176. Similarly, the electrode 104 and its associated assembly is mounted within the stainless steel bellows 178, which is in turn mounted within the transversely extending housing 180 with its enclosing end plate 182. The unit 186 having the enclosing water jacket 128, and having the central electric arc plasma discharge region 112 is also shown separately in FIG. 6. In addition, the ends of unit 186 are shown in an upper end view the inner cylindrical member 190 from which the orifices 116 provide water jets into the zone 112, is also shown separately in FIG. 6. In addition, the ends 192 and 194 are shown in separate views. Finally, to the right in FIG. 6 is shown the heat exchange cylinder 166 which includes, for example, the water jacket 132.

Figure 7:
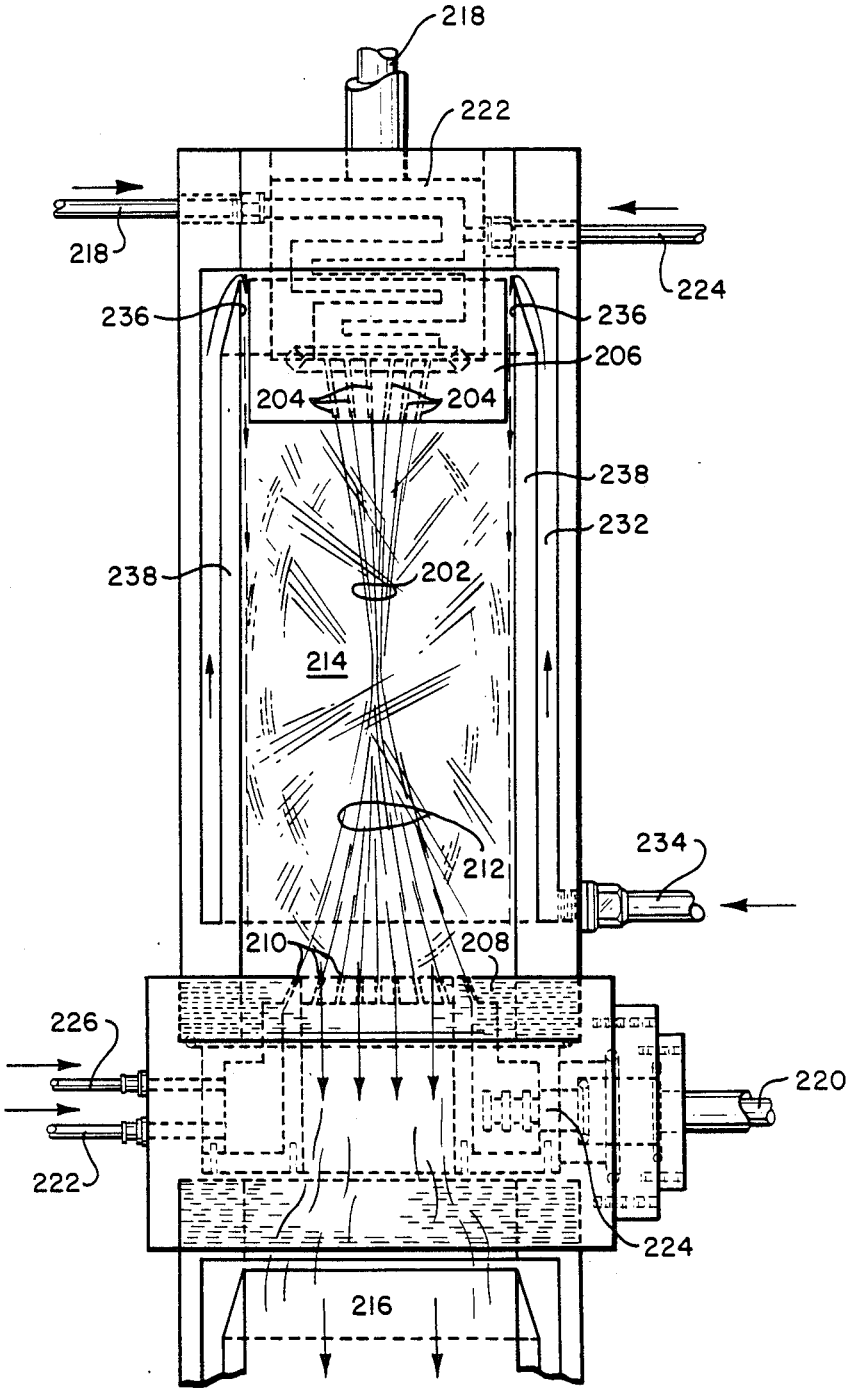
FIG. 7 is a partial cross-sectional view of a further alternative embodiment of the invention.

Referring now to FIG. 7 of the drawings, FIG. 7 is a showing of a further alternative input arc discharge assembly which may be employed in the implementation of the invention. The embodiment of FIG. 7 is somewhat similar to that of FIG. 1 in that a dilute electrolyte is sprayed as indicated at reference numeral 202 through apertures 204 in the ceramic block 206. Unlike the arrangements of FIG. 1, however, in FIG. 7 a ring-shaped ceramic member 208 is provided with apertures 210 for spraying dilute electrolyte upward in a somewhat converging conical spray 212, toward the downwardly directed spray 202. The center of the lower ceramic member 208 is open so that the ionized gases from chamber 214 may expand downwardly into zone 216 where appropriate heat exchangers are provided, of the types shown to the right in each of FIGS. 1 and 2.

Massive insulated input conductors 218 and 220 supply power to the electrodes 222 and 224, respectively, with the electrode spacing being in the order of 48 inches, and the power being supplied at a voltage in the order of 2500 volts.

Relatively concentrated electrolyte is supplied to the unit of FIG. 7 through conduits 218 and 222, and dilution is accomplished by water supplied through pipes 224 and 226 so that good mixing is accomplished prior to spraying from the apertured ceramic members 206 and 208, respectively.

The result is a vigorous electric arc discharge in the center of the chamber 214, with the resultant ionization of the sprayed water, and a downward flow of the stream of ionized gases into chamber 216 as indicated by the arrows toward the lower zones in FIG. 7.

Cooling water is supplied to the cooling jacket 232 from input conduit 234. The cooling water flows upward through the jacket 232 and enters the very thin peripheral opening 236 and is permitted to flow down the inner surface of the side walls 238 of the chamber 214. The water serves to protect and cool the walls 238, and the water is converted to steam and then ionized as it is exposed to the intense heat and the ionized gases resulting from the arc discharge at the center of chamber 214. Instead of flowing down the side walls as discussed above, the slot 236 may be made very narrow, and direct a spray "curtain" of water adjacent the side walls 238 of the enclosing chamber.

With regard to certain other aspects of the apparatus disclosed hereinabove, the matter of materials which may be used deserves at least passing consideration. The principal materials which are used include a machinable electrically insulating ceramic material, and stainless steel. The machinable ceramic material, which may be "Marcor", available from Corning Glass Co., is employed adjacent the electrodes, to prevent an electrical discharge across to the walls of the chambers, and is used for example, for parts 206, 208, and 238 in FIG. 7. The main portion of the units in each case, away from the arc discharge electrodes, is formed of stainless steel; and the heat exchange coils, such as the coils 56 in FIG. 1 and 138 and 150 in FIGS. 2 and 5, for example, are formed of stainless steel tubing. The units may be enclosed in ceramic wool insulation, for example. The alumina type known as KaoWool, available from Babcock and Wilcox, is indicated at 78 in FIG. 1. The water supplied to the units is insulating, pure, distilled water, for control purposes and to avoid flow of electricity. Instead of using a strong electrolyte tank, and then diluting it, fine powder dispensers for the electrolyte may be provided adjacent the point of use or of spraying of the electrolyte and water solution to provide closer electric current flow control. In the foregoing description, it was mentioned that, with an electrode spacing in the order of 48 inches, a voltage in the order of 2500 volts could be used. With lesser electrode spacings, for example about seven inches, a voltage of about 200 to 240 volts may be employed, with the power being in the order of 200 kilowatts, in order to implement a smaller unit.

Now that the detailed description of the present invention has been completed, reference is made to certain prior art articles relating to electric art plasma technology. These include an article entitled "Production Experience with Plasma Technology in Metallurgical Processing", by Hans G. Herlitz, reprinted from "Iron and Steel Engineer" August 1985; and Technical Report, dated January 1984, entitled "SKF Steel's Plasma Technology" by Hans G. Herlitz. These publications describe the application of electric are plasma technology to steel industry fields of interest.

In conclusion, the accompanying drawings and the foregoing detailed description relate to illustrative embodiments of the invention. It is to be understood, however, that the invention is not limited to the precise structure as shown in the drawings and as described in detail hereinabove. Thus, by way of example, and not of limitation, the formation of steam using electric arc plasma generation, can take somewhat different configuration. Thus, the electrode configuration may be in the form of concentric rings, instead of the linear electrodes as shown in the two embodiments of the invention, and the water jackets and cooling coils from which super-heated steam is obtained may be arranged in different configurations both as to their geometry, and to their flow paths. Further, the output from the main arc plasma envelope need not be directed to the steam expansion chamber to which the super-heated water is applied, but may be used directly in cases where such direct use of the steam is advantageous or desirable. It is also to be understood that additional valving may be employed where desired, in order to control the flow of spray water into the electrode area in the case of FIG. 1, and into the electric arc plasma zone in the case of the embodiments of both FIGS. 1 and 2. In addition, the unit of Fig. 2 may be provided with selective sump or drain arrangements, to insure that there is not an undesirable collection of water in zone 112 at start-up. Accordingly, the present invention is not limited to that as shown and described in detail hereinabove.

What is claimed is:

1. An electric arc plasma steam generator comprising:

first and second spaced electrode means for supplying power to an electric arc;

means for spraying a dilute water solution of electrolyte into the space between said electrodes to form an electric arc plasma to convert the water into steam and to ionize the hydrogen and oxygen of the steam to form an electric arc plasma;

a housing for enclosing the arc plasma;

first and second chambers for containing said electrolyte in conductive contact with said first and second electrodes, respectively;

said spraying means including means for directing jets of said electrolyte from each of said chambers toward a central zone within said housing;

means for supplying additional water into said housing along the walls thereof in the vicinity of said central zone, to absorb heat from said arc plasma and to vaporize the additional water;

a heat transfer chamber having an input and an output, and having the input thereto coupled to said electric arc plasma housing;

heat transfer means including water circulation channels located in and around said heat transfer chamber, means for circulating water through said channels to super-heat the water circulating therein to a temperature well above the boiling point of water;

an expansion chamber;

means for coupling the super-heated water from said circulating means to said expansion chamber to form steam in said expansion chamber; and means for also coupling the output from said heat transfer chamber to said expansion chamber.

2. An electric arc plasma steam generator as defined in claim 1 wherein said channels include a coil of tubing exposed to said heat transfer chamber.

3. An electric arc plasma steam generator as defined in claim 2 wherein said coil is conical.

4. An electric arc plasma steam generator as defined in claim 2 wherein said coil is substantially cylindrical and is located adjacent the walls of said housing.

5. An electric arc plasma steam generator as defined in claim 1 wherein said spraying means includes first and second spaced means for directing said jets in a converging pattern, from opposite directions.

6. An electric are plasma steam generator as defined in claim 1 including means for applying sufficient power to said electrodes to raise the temperature within the arc plasma housing to a temperature above 50,000 degrees F.

7. An electric arc plasma steam generator as defined in claim 1 including means for applying sufficient power to said electrodes to raise the temperature within the arc plasma housing to a temperature above 10,000 degrees F.

8. An electric arc plasma steam generator comprising:

first and second spaced electrode means for supplying power to an electric arc;

means for spraying a dilute water solution of electrolyte into the space between said electrodes to form an electric arc plasma to convert the water into steam and to ionize the hydrogen and oxygen of the steam to form an electric arc plasma;

a housing for enclosing the arc plasma;

first and second chambers for containing said electrolyte in conductive contact with said first and second electrodes, respectively;

said spraying means including means for directing jets of said electrolyte from each of said chambers toward a central zone within said housing;

water circulating means for absorbing heat generated by said arc plasma to super-heat the water circulating therein to a temperature well above the boiling point of water;

an expansion chamber; and means for coupling the super-heated water from said circulating means to said expansion chamber to form steam in said expansion chamber.

9. An electric arc plasma steam generator as defined in claim 8 wherein means are provided for coupling said housing to said expansion chamber.

10. An electric arc plasma steam generator as defined in claim 8 wherein means are provided for supplying additional water to said housing to absorb heat from said arc discharge.

11. An electric arc plasma steam generator as defined in claim 10 wherein said water is supplied along the walls of said housing around the area where said arc discharge takes place.

12. An electric arc plasma steam generator as defined in claim 8 wherein said spraying means includes first and second spaced means for directing said jets in a converging pattern, from opposite directions.

13. An electric arc plasma steam generator as defined in claim 8 including means for applying sufficient power to said electrodes to raise the temperature within the arc plasma housing to a temperature above 50,000 degrees F.

14. An electric arc plasma steam generator as defined in claim 8 including means for applying sufficient power to said electrodes to raise the temperature within the arc plasma housing to a temperature above 10,000 degrees F.

15. An electric arc plasma steam generator comprising:

electrode means for supplying power to an electric arc;

means for directing water into said electric arc to convert the water into steam and to ionize the hydrogen and oxygen of the steam to form an electric arc plasma;

a housing for enclosing the arc plasma;

a heat transfer chamber having an input and an output, and having the input thereto coupled to said electric arc plasma housing;

heat transfer means including water circulation channels located in and around said heat transfer chamber, means for circulating water through said channels to super-heat the water circulating therein to a temperature well above the boiling point of water;

an expansion chamber;

means for coupling the super-heated water from said circulating means to said expansion chamber to form steam in said expansion chamber; and means for also coupling the output from said heat transfer chamber to said expansion chamber.

16. An electric arc plasma steam generator as defined in claim 15 further comprising means for forming a concentrated solution of electrolyte, means for diluting said concentrated solution by mixing with additional water, and means for spraying fine jets of the diluted electrolyte into the zone between said electrodes.

17. An electric arc plasma steam generator as defined in claim 15 wherein said heat transfer means includes at least one coil of metal tubing exposed to the ionized hydrogen and oxygen from said electric arc plasma.

18. An electric arc plasma steam generator as defined in claim 15 including means for applying sufficient power to said electrodes to raise the temperature within the arc plasma housing to a temperature above 50,000 degrees F.

19. An electric arc plasma steam generator as defined in claim 15 including means for applying sufficient power to said electrodes to raise the temperature within the arc plasma housing to a temperature above 10,000 degrees F.

* * * * *